US008652732B2

(12) United States Patent
Zwartz et al.

(10) Patent No.: US 8,652,732 B2
(45) **Date of Patent: *Feb. 18, 2014**

(54) TUNABLE GLOSS TONERS

(71) Applicant: Xerox Corporation, Norwalk, CT (US)

(72) Inventors: Edward G. Zwartz, Mississauga (CA); T. Brian McAneney, Burlington (CA); Valerie M. Farrugia, Oakville (CA); Jordan H. Wosnick, Toronto (CA); Richard P N Veregin, Mississauga (CA); Eric Rotberg, Toronto (CA)

(73) Assignee: Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/784,757

(22) Filed: Mar. 4, 2013

(65) Prior Publication Data

US 2013/0183615 A1 Jul. 18, 2013

Related U.S. Application Data

(62) Division of application No. 12/709,690, filed on Feb. 22, 2010, now Pat. No. 8,431,302.

(51) Int. Cl.
*G03G 9/00* (2006.01)

(52) U.S. Cl.
USPC ..... 430/109.4; 430/108.1; 430/108.3; 430/109.1

(58) Field of Classification Search
USPC ..... 430/108.1, 108.3, 109.1, 109.4
See application file for complete search history.

(56) References Cited

U.S. PATENT DOCUMENTS

| | | | |
|---|---|---|---|
| 3,590,000 | A | 6/1971 | Palermiti |
| 3,681,106 | A | 8/1972 | Burns |
| 3,800,588 | A | 4/1974 | Larson |
| 3,847,604 | A | 11/1974 | Hagenbach |
| 4,295,990 | A | 10/1981 | Verbeek |
| 4,298,672 | A | 11/1981 | Lu |
| 4,338,390 | A | 7/1982 | Lu |
| 4,533,614 | A | 8/1985 | Fukumoto |
| 4,845,006 | A | 7/1989 | Matsubara |
| 4,863,824 | A | 9/1989 | Uchida |
| 4,863,825 | A | 9/1989 | Yoshimoto |
| 4,917,983 | A | 4/1990 | Uchida |
| 4,931,370 | A | 6/1990 | Amaya |
| 4,933,252 | A | 6/1990 | Nishikawa |
| 4,935,326 | A | 6/1990 | Creatura |
| 4,937,166 | A | 6/1990 | Creatura |
| 4,957,774 | A | 9/1990 | Doi |
| 4,973,539 | A | 11/1990 | Sacripante |
| 4,980,448 | A | 12/1990 | Tajiri |
| 4,981,939 | A | 1/1991 | Matsumura |
| 4,988,794 | A | 1/1991 | Kubo |
| 5,057,596 | A | 10/1991 | Kubo |
| 5,143,809 | A | 9/1992 | Kaneko |
| 5,227,460 | A | 7/1993 | Mahabadi |
| 5,234,783 | A | 8/1993 | Ng |
| 5,236,629 | A | 8/1993 | Mahabadi |
| 5,290,654 | A | 3/1994 | Sacripante |
| 5,302,486 | A | 4/1994 | Patel |
| 5,330,874 | A | 7/1994 | Mahabadi |
| 5,376,494 | A | 12/1994 | Mahabadi |

(Continued)

*Primary Examiner* — Stewart Fraser
(74) *Attorney, Agent, or Firm* — MDIP LLC

(57) ABSTRACT

The present disclosure provides toners having a tunable gloss level, electrophotographic apparatus for suing such toners as well as processes for making such toners.

20 Claims, 8 Drawing Sheets

(56) References Cited

U.S. PATENT DOCUMENTS

| | | | | |
|---|---|---|---|---|
| 5,480,756 | A | 1/1996 | Mahabadi | |
| 5,500,324 | A | 3/1996 | Mahabadi | |
| 5,556,732 | A * | 9/1996 | Chow | 430/137.1 |
| 5,601,960 | A | 2/1997 | Mahabadi | |
| 5,629,121 | A | 5/1997 | Nakayama | |
| 5,650,484 | A | 7/1997 | Hawkins | |
| 5,666,592 | A | 9/1997 | Aslam | |
| 5,709,973 | A | 1/1998 | Chen | |
| 5,716,750 | A | 2/1998 | Tyagi | |
| 5,750,909 | A | 5/1998 | Hawkins | |
| 5,751,432 | A | 5/1998 | Gwaltney | |
| 5,887,235 | A | 3/1999 | Wayman | |
| 6,101,345 | A | 8/2000 | Van Goethem | |
| 6,214,507 | B1 | 4/2001 | Sokol | |
| 6,326,119 | B1 | 12/2001 | Hollenbaugh | |
| 6,358,657 | B1 | 3/2002 | Silence | |
| 6,359,105 | B1 | 3/2002 | Ianni | |
| 6,438,336 | B1 | 8/2002 | Bengtson | |
| 6,505,832 | B2 | 1/2003 | Moore | |
| 6,535,712 | B2 | 3/2003 | Richards | |
| 6,592,913 | B2 | 7/2003 | Cook | |
| 6,593,053 | B1 | 7/2003 | Chang | |
| 6,805,481 | B2 | 10/2004 | Kumar | |
| 6,983,119 | B2 | 1/2006 | Nakayama | |
| 7,037,633 | B2 | 5/2006 | Hopper | |
| 7,058,348 | B2 | 6/2006 | Aslam | |
| 7,088,946 | B2 | 8/2006 | Behnke | |
| 7,139,521 | B2 | 11/2006 | Ng | |
| 7,304,770 | B2 | 12/2007 | Wang | |
| 7,329,476 | B2 | 2/2008 | Sacripante | |
| 7,395,021 | B2 | 7/2008 | Tamura | |
| 8,431,302 | B2 * | 4/2013 | Zwartz et al. | 430/109.4 |
| 2006/0216626 | A1 | 9/2006 | Sacripante | |
| 2008/0107990 | A1 | 5/2008 | Field | |
| 2008/0236446 | A1 | 10/2008 | Zhou | |
| 2009/0047593 | A1 | 2/2009 | Vanbesien | |
| 2009/0257773 | A1 | 10/2009 | Barton | |
| 2010/0248118 | A1 * | 9/2010 | Gong et al. | 430/108.2 |
| 2011/0143274 | A1 | 6/2011 | Iftime | |
| 2011/0206400 | A1 * | 8/2011 | Zwartz et al. | 399/53 |

* cited by examiner

TUNABLE GLOSS TONERS

BACKGROUND

The present disclosure relates to toners, electrophotographic apparatuses for using such toners as well as processes for making such toners.

Toner blends containing crystalline or semi-crystalline polyester resins with an amorphous resin have been recently shown to provide very desirable ultra low melt fusing, which is important for both high-speed printing and lower fuser power consumption. These types of toners containing crystalline polyesters have been demonstrated suitable for both emulsion aggregation (EA) toners, and in conventional jetted toners. Combinations of amorphous and crystalline polyesters may provide toners with relatively low-melting point characteristics (sometimes referred to as low-melt, ultra low melt or ULM), which allows for more energy efficient and faster printing.

Toners may include various additives that control the level of gloss of the printed document. There are limited options for varying the degree of gloss of electrophotographic printing on an individual basis. The desired level of gloss varies based on the applications, markets, and substrates. Most of the options in adjusting the level of gloss are hardware-related, such as adjusting the fuser speed and/or fuser roll temperature. This approach may have limitations. For example, lower speeds impact productivity, while increasing fuser roll temperature, which reduces fuser roll life, in addition, there is a risk of poor adhesion of toner to the paper (e.g., while printing matte at lower temperatures and faster speeds) or toner adhering to the fuser roll (e.g., while printing glossy at higher temperatures and lower speeds). Improved methods for producing totters which are suitable for use in creating documents of varying gloss remain desirable.

SUMMARY

The present disclosure provides for a process including: forming at least one clear glossy toner having an aluminum content from about 20 ppm to about 200 ppm, forming at least one clear matte toner having an aluminum content from about 500 ppm to about 1000 ppm and contacting the at least one clear glossy toner and the at least one clear matte toner at a weight ratio from about 10:90 to about 90:10 to obtain a blended toner having a gloss level from about 5 ggu to about 90 ggu.

The present disclosure also provides for a toner comprising at least one clear glossy toner having an aluminum content from about 50 ppm to about 100 ppm and at least one clear matte toner having an aluminum content from about 600 ppm to about 800 ppm. The at least one clear glossy toner and the at least one clear matte toner are present at a weight ratio from about 10:90 to about 90:10 and the toner has a gloss level from about 5 ggu to about 90 ggu.

A process is also contemplated by the present disclosure. The process includes forming at least one clear glossy toner having an aluminum content from about 50 ppm to about 100 ppm, forming at least one clear matte toner having an aluminum content from about 600 ppm to about 800 ppm and contacting the at least one clear glossy toner and the at least one clear matte toner at a weight ratio from about 10:90 to about 90:10 to obtain a blended toner having a gloss level from about 5 ggu to about 90 ggu. Each of the at least one clear glossy toner and the at least one matte toner includes at least one amorphous resin, at least one crystalline resin, at least one ionic crosslinker, and optionally, one or more ingredients selected from the group consisting of waxes, coagulants, chelating agents and combinations thereof.

DESCRIPTION OF THE DRAWINGS

Various embodiments of the present disclosure will be described herein below with reference to the figure wherein.

DETAILED DESCRIPTION

Figure 1:
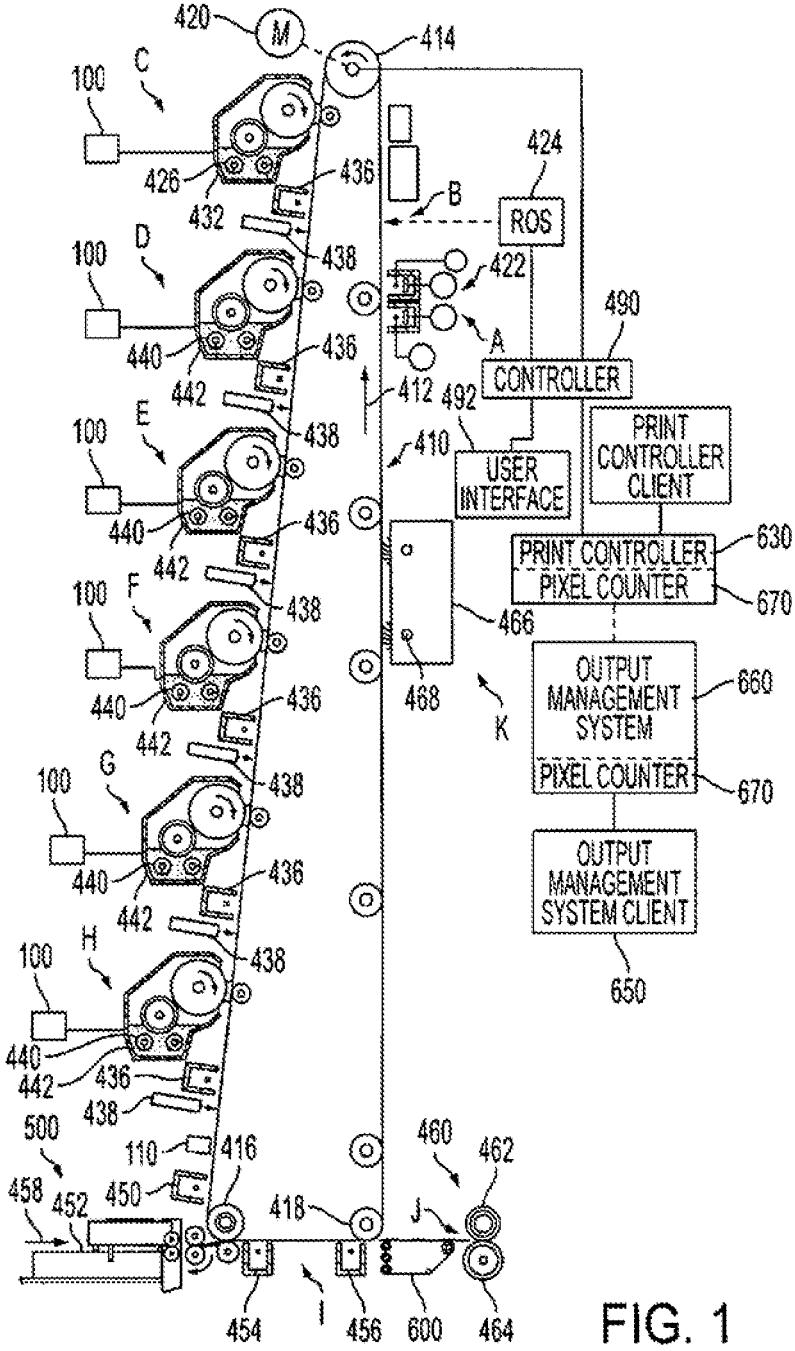
FIG. 1 is a schematic view of a full color image-on-image single-pass electrophotographic printing apparatus that may be used in accordance with the present disclosure.

The present disclosure relates to toners, electrophotographic apparatuses for using such toners as well as processes for making such toners. Toners of the present disclosure may be prepared from a resin latex in combination with an ionic crosslinker to adjust the desired gloss of the toner compositions, such toners may also optionally include a wax. While the resin latex may be prepared by any method within the purview of those skilled in the art, in embodiments the resin latex may be prepared by solvent flashing methods, as well as emulsion polymerization methods, including semi-continuous emulsion polymerization and the toner may include emulsion, aggregation toners. Emulsion aggregation involves aggregation of both submicron latex and pigment particles into toner size particles, where the growth in particle size is, for example, in embodiments from about 0.1 micron to about 15 microns.

In embodiments, a toner composition of the present disclosure may include at least one low molecular weight amorphous polyester resin, at least one high molecular weight amorphous polyester resin, at least one crystalline polyester resin, at least one wax, and at least one colorant. The at least one low molecular weight amorphous polyester resin may have a weight average molecular weight of from about 10,000 to about 35,000, in embodiments from about 15,000 to about 30,000, and may be present in the toner composition in an amount of about 20 to about 50 weight percent, in embodiments from about 22 to about 45 weight percent. The at least one high molecular weight amorphous polyester resin may have a weight average molecular weight of from about 35,000 to about 150,000, in embodiments from about 45,000 to about 140,000, and may be present in the toner composition in an amount of about 20 to about 50 weight percent, in embodiments from about 22 to about 45 weight percent. The at least one crystalline polyester resin may be present in the toner composition in an amount of 1 to about 15 weight percent, in embodiments from about 3 to about 10 weight percent. The ratio of high molecular weight amorphous resin to low molecular weight amorphous resin to crystalline resin may be from about 6:6:1 to about 5:5:1, in embodiments from about 5.8:5.8:1 to about 5.2:5.2:1. The at least one wax may be present in the toner composition in an amount of 1 to about 15 weight percent, in embodiments from about 3 to about 11 weight percent. The at least one colorant may be present in the toner composition in an amount of 1 to about 18 weight percent, in embodiments from about 3 to about 14 weight percent.

Resins

Any toner resin may be utilized in the processes of the present disclosure. Such resins, in turn, may be made of any suitable monomer or monomers via any suitable polymerization method. In embodiments, the resin may be prepared by a method other than emulsion polymerization. In further embodiments, the resin may be prepared by condensation polymerization.

The toner composition also includes at least one low molecular weight amorphous polyester resin. The low molecular weight amorphous polyester resins, which are available from a number of sources, can possess various melting points of, for example, from about 30° C. to about 120° C., in embodiments from about 75° C. to about 115° C., in embodiments from about 180° C. to about 110° C., and/or in embodiments from about 104° C. to about 108° C. As used herein, the low molecular weight amorphous polyester resin has, for example, a number average molecular weight ($M_n$), as measured by gel permeation chromatography (GPC) of, for example, from about 1,000 to about 10,000, in embodiments from about 2,000 to about 8,000, in embodiments from about 3,000 to about 7,000, and in embodiments from about 4,000 to about 6,000. The weight average molecular weight ($M_w$) of the resin is 50,000 or less, for example, in embodiments from about 2,000 to about 50,000, in embodiments from about 3,000 to about 40,000, in embodiments from about 10,000 to about 30,000, and in embodiments from about 18,000 to about 21,000, as determined by GPC using polystyrene standards. The molecular weight distribution ($M_w/M_n$) of the low molecular weight amorphous resin is, for example, from about 2 to about 6, in embodiments from about 3 to about 4. The Low molecular weight amorphous polyester resins may have an acid value of from about 2 to about 30 mg KOH/g, in embodiments from about 9 to about 16 mg KOH/g, and in embodiments from about 10 to about 14 mg KOH/g.

Examples of the linear amorphous polyester resins include poly(propoxylated bisphenol A co-fumarate), poly(ethoxylated bisphenol A co-fumarate), poly(butyloxylated bisphenol A co-fumarate), poly(co-propoxylated bisphenol A co-ethoxytated bisphenol A co-fumarate), poly(1,2-propylene fumarate), poly(propoxylated bisphenol A co-maleate), poly (ethoxylated bisphenol A co-maleate), poly(butyloxylated bisphenol A co-maleate), poly(co-propoxylated bisphenol A co-ethoxylated bisphenol A co-maleate), poly(1,2-propylene maleate, poly(propoxylated bisphenol A co-itaconate), poly (ethoxylated bisphenol A co-itaconate, poly(butyloxylated bisphenol A co-itaconate), poly(co-propoxylated bisphenol A co-ethoxylated bisphenol A co-itaconate), poly(1,2-propylene itaconate), and combinations thereof.

In embodiments, a suitable linear amorphous polyester resin may be a poly(propoxylated bisphenol A co-fumarate) resin having the following formula (I):

(I)

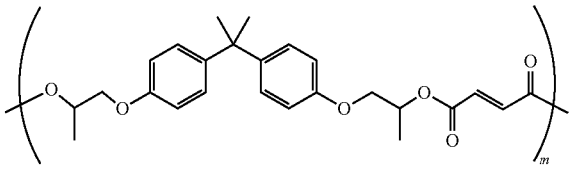

(I)

wherein m may be from about 5 to about 1000.

An example of a linear propoxylated bisphenol A fumarate resin which may be utilized as a latex resin is available under the trade name SPARII™ from Resana S/A Industries Quimicas, Sao Paulo Brazil. Other suitable linear resins include those disclosed in U.S. Pat. Nos. 4,533,614, 4,957,774 and 4,533,614, which can be linear polyester resins including terephthalic acid, dodecylsuccinic acid, trimellitic acid, fumaric acid and alkyloxylated bisphenol A, such as, for example, bisphenol-A ethylene oxide adducts and bisphenol-A propylene oxide adducts. Other propoxylated bisphenol A terephthalate resins that may be utilized and are commercially available include GTU-FC115, commercially available from Kao Corporation, Japan, and the like.

In embodiments, the low molecular weight amorphous polyester resin may be a saturated or unsaturated amorphous polyester resin. Illustrative examples of saturated and unsaturated amorphous polyester resins selected for the process and particles of the present disclosure include any of the various amorphous polyesters, such as polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-isophthalate, polypropylene-isophthalate, polybutylene-isophthalate, polypentylene-isophthalate, polyhexalene-isophthalate, polyheptadene-isophthalate, polyoctalene-isophthalate, polyethylene-sebacate, polypropylene sebacate, polybutylene-sebacate, polyethylene-adipate, polypropylene-adipate, polybutylene-adipate, polypentylene-adipate, polyhexalene-adipate, polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate polyethylene-pimelate, polypropylene-pimelate, polybutylene-pimelate, polypentylene-pimelate, polyhexalene-pimelate, polyheptadene-pimelate, poly(ethoxylated bisphenol A-fumarate), poly (ethoxylated bisphenol A-succinate), poly(ethoxylated bisphenol A-adipate), poly(ethoxylated bisphenol A-glutarate), poly(ethoxylated bisphenol A-terephthalate), poly (ethoxylated bisphenol A-isophthalate), poly(ethoxylated bisphenol A-dodecenylsuccinate), poly(propoxylated bisphenol A-fumarate), poly(propoxylated bisphenol A-succinate), poly(propoxylated bisphenol A-adipate), poly(propoxylated bisphenol A-glutarate), poly(propoxylated bisphenol A-terephthalate), poly(propoxylated bisphenol A-isophthalate), poly(propoxylated bisphenol A-dodecenylsuccinate), SPAR (Dixie Chemicals), BECKOSOL (Reichhold Inc), ARAKOTE (Ciba-Geigy Corporation), HETRON (Ashland Chemical), PARAPLEX (Rohm & Haas), POLYLITE (Reichhold Inc), PLASTHALL (Rohm & Haas), CYGAL (American Cyanamide), ARMCO (Armco Composites), ARPOL (Ashland Chemical), CELANEX (Celanese Eng), RYNITE (DuPont), STYPOL (Freeman Chemical Corporation) and combinations thereof. The resins can also be functionalized, such as carboxylated, sulfonated, or the like, and particularly such as sodio sulfonated, if desired.

The low molecular weight amorphous resins, linear or branched, which are available from a number of sources, can possess various onset glass transition temperatures (Tg) of for example, from about 40° C., to about 80° C., in embodiments from about 50° C. to about 70° C., and in embodiments from about 58° C. to about 62° C., as measured by differential scanning calorimetry (DSC). The linear and branched amorphous polyester resins, in embodiments, may be a saturated or unsaturated resin.

The low molecular weight linear amorphous polyester resins are generally prepared by the polycondensation of an organic diol, a diacid or diester, and a polycondensation catalyst. The low molecular weight amorphous resin is generally present in the toner composition in various suitable amounts, such as from about 60 to about 90 weight percent, in embodiments from about 50 to about 65 weight percent, of the toner or of the solids.

Examples of organic diols selected for the preparation of low molecular weight resins include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of diacid or diesters selected for the preparation of the low molecular weight amorphous polyester include dicarboxylic acids or diesters selected from the group consisting of terephthalic acid, phthalic acid, isophthalic acid, fumaric acid, maleic acid, itaconic acid, succinic acid, succinic anhydride, dodecylsuccinic acid, dodecylsuccinic anhydride, dodecenylsuccinic acid, dodecenylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, dimethyl dodecenylsuccinate, and mixtures thereof. The organic diacid or diester is selected, for example, from about 45 to about 52 mole percent of the resin.

Examples of suitable polycondensation catalyst for either the low molecular weight amorphous polyester resin include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof; and which catalysts are selected in amounts of, for example, from about 0.01 mole percent to about 5 mole percent based on the starting diacid or diester used to generate the polyester resin.

The low molecular weight amorphous polyester resin may be a branched resin. As used herein, the terms "branched" or "branching" includes branched resin and/or cross-linked resins. Branching agents for use in forming these branched resins include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected is, for example, from about 0.1 to about 5 mole percent of the resin.

Linear or branched unsaturated polyesters selected for the in situ pre-wise reactions between both saturated and unsaturated diacids (or anhydrides) and dihydric alcohols (glycols or diols). The resulting unsaturated polyesters are reactive (for example, crosslinkable) on two fronts: (i) unsaturation sites (double bonds) along the polyester chain, and (ii) functional groups such as carboxyl, hydroxy, and the like groups amenable to acid-base reactions. Typical unsaturated polyester resins are prepared by melt polycondensation or other polymerization processes using diacids and/or anhydrides and diols.

In embodiments, the low molecular weight amorphous polyester resin or a combination of low molecular weight amorphous resins may have a glass transition temperature of from about 30° C. to about 80° C., in embodiments from about 35° C. to about 70° C. In further embodiments, the combined amorphous resins may have a melt viscosity of from about 10 to about 1,000,000 Pa·S at about 130° C., in embodiments from about 50 to about 100,000 Pa·S.

The monomers used in making the selected amorphous polyester resin are not limited, and the monomers utilized may include any one or more of, for example, ethylene, propylene, and the like. Known chain transfer agents, for example dodecanethiol or carbon tetrabromide, can be utilized to control the molecular weight properties of the polyester. Any suitable method for forming the amorphous or crystalline polyester from the monomers may be used without restriction.

The amount of the low molecular weight amorphous polyester resin in a toner particle of the present disclosure, whether in core, shell or both, may be present in an amount of from 25 to about 50 percent by weight, in embodiments from about 30 to about 45 percent by weight, and in embodiments from about 35 to about 43 percent by weight, of the toner particles that is, toner particles exclusive of external additives and water).

In embodiments, the toner composition includes at least one crystalline resin. As used herein, "crystalline" refers to a polyester with a three dimensional order. "Semicrystalline resins" as used herein refers to resins with a crystalline percentage of, for example, from about 10 to about 90%, in embodiments from about 12 to about 70%. Further, as used hereinafter "crystalline polyester resins" and "crystalline resins" encompass both crystalline resins and semicrystalline resins, unless otherwise specified.

In embodiments, the crystalline polyester resin is a saturated crystalline polyester resin or an unsaturated crystalline polyester resin.

The crystalline polyester resins, which are available from a number of sources, may possess various melting points of, for example, from about 30° C. to about 120° C., in embodiments from about 50° C. to about 90° C. The crystalline resins may have, for example, a number average molecular weight ($M_n$), as measured by gel permeation chromatography (GPC) of, for example, from about 1,000 to about 50,000, in embodiments from about 2,000 to about 25,000, in embodiments from about 3,000 to about 15,000, and in embodiments from about 6,000 to about 12,000. The weight average molecular weight ($M_w$) of the resin is 50,000 or less, for example, from about 2,000 to about 50,000, in embodiments from about 3,000 to about 40,000, in embodiments from about 10,000 to about 30,000 and in embodiments from about 21,000 to about 24,000, as determined by GPC using polystyrene standards. The molecular weight, distribution ($M_w/M_n$) of the crystalline resin is, for example, from about 2 to about 6, in embodiments from about 3 to about 4. The crystalline polyester resins may have an acid value of about 2 to about 20 mg KOH/g, in embodiments from about 5 to about 15 mg KOH/g, and in embodiments from about 8 to about 13 mg KOH/g. The acid value (or neutralization number) is the mass of potassium hydroxide (KOH) in milligrams that is required to neutralize one gram of the crystalline polyester resin.

Illustrative examples of crystalline polyester resins may include any of the various crystalline polyesters, such as poly(ethylene-adipate), polypropylene-adipate), poly(butylene-adipate), poly(pentylene-adipate), poly(hexylene-adipate), poly(octylene-adipate), poly(ethylene-succinate), polypropylene-succinate, poly(butylene-succinate), poly (pentylene-succinate), poly(hexylene-succinate), poly(octylene-succinate), poly(ethylene-sebacate), poly(propylene sebacate), poly(butylene-sebacate), poly(pentylene-sebacate), poly(hexylene-sebacate), poly(octylene-sebacate), poly(nonylene-sebacate), poly(decylene-sebacate), poly(undecylene-sebacate), poly(dodecylene-sebacate), poly(ethylene-dodecanedioate), poly(propylene-dodecanedioate), poly (butylene-dodecanedioate), poly(pentylene-dodecanedioate), poly(hexylene-dodecanedioate), poly (octylene-dodecanedioate), poly(nonylene-dodecanedioate), poly(decylene-dodecandioate), poly(undecylene-dodecandioate), poly(dodecylene-dodecandioate), poly(ethylene-fumarate), poly(propylene-fumarate), poly(butylene-fumarate), poly(pentylene-fumarate), poly(hexylene-fumarate), poly(octylene-fumarate), poly(nonylene-fumarate), poly(decylene-fumarate), copoly(5-sulfoisophthaloyl)-copoly(ethylene-adipate), copoly(5-sulfoisophthaloyl)-copoly(propylene-adipate), copoly(5-sulfoisophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfoisophthaloyl)-copoly(ethylene-succinate), copoly(5-sulfoisophthaloyl)-copoly(propylene-succinate), copoly(5-sulfoisophthaloyl)-copoly(butylene-succinate), copoly(5-sulfoisophthaloyl)-copoly(pentylene-succinate), copoly(5-sulfoisophthaloyl)-copoly(hexylene-succinate), copoly(5-sulfoisophthaloyl)-copoly(octylene-succinate), copoly(5-sulfo-isophthaloyl)-copoly(ethylene-sebacate), copoly(5-sulfo-isophthaloyl)-copoly(propylene-sebacate), copoly(5-sulfo-isophthaloyl)-copoly(butylenes-sebacate), copoly(5-sulfo-isophthaloyl)-copoly(pentylene-sebacate), copoly(5-sulfo-isophthaloyl)-copoly(hexylene-sebacate), copoly(5-sulfo-isophthaloyl)-copoly(octylene-sebacate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(5-sulfo-isophthaloyl)-copoly(hexylene-adipate) and combinations thereof.

The crystalline resin may be prepared by a polycondensation process by reacting suitable organic diol(s) and suitable organic diacid(s) in the presence of a polycondensation catalyst. Generally, a stoichiometric equimolar ratio of organic diol and organic diacid is utilized, however, in some instances, wherein the boiling point of the organic diol is from about 180° C. to about 230° C., an excess amount of diol can be utilized and removed during the polycondensation process. The amount of catalyst utilized varies, and may be selected in an amount, for example, of from about 0.01 to about 1 mole percent of the resin. Additionally, in place of the organic diacid, an organic diester can also be selected, and where an alcohol byproduct is generated. In further embodiments, the crystalline polyester resin is a poly(dodecandioicacid-co-nonanediol.

Examples of organic diols selected for the preparation of crystalline polyester resins include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonandiol, 1,10-decanediol, 1,12-dodecanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of organic diacids or diesters selected for the preparation of the crystalline polyester resins include oxalic acid, succinic acid, glutaric acid, adipic acid, suberic acid, azelaic acid, sebacic acid, phthalic acid, isophthalic acid, terephthalic acid, napthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfo-p-hydroxybenzoic acid, N,N-bis(2-hydroxyethyl)-2-amino ethane sultanate, or mixtures thereof. The organic diacid is selected in an amount of, for example, from about 40 to about 50 mole percent of the resin, and the alkali sulfoaliphatic diacid can be selected in an amount of from about 1 to about 10 mole percent of the resin.

Suitable crystalline polyester resins include those disclosed in U.S. Pat. No. 7,329,476 and U.S. Patent Application Pub. Nos. 2006/0216626, 2008/0107990, 2008/0236446 and 2009/0047593, each of which is hereby incorporated by reference in their entirety. In embodiments, a suitable crystalline resin may include a resin composed of ethylene glycol or nonanediol and a mixture of dodecanedioic acid and fumaric acid co-monomers with the following formula (II):

(II)

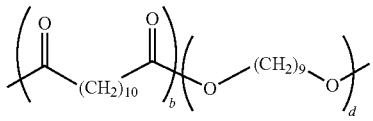

wherein b is from about 5 to about 2000 and d is from about 5 to about 2000.

If semicrystalline polyester resins are employed herein, the semicrystalline resin may include poly(3-methyl-1-butene), poly(hexamethylene carbonate), poly(ethylene-p-carboxy phenoxy-butyrate), poly(ethylene-vinyl acetate), poly(docosyl acrylate), poly(dodecyl acrylate), poly(octadecyl acrylate), poly(octadecyl methacrylate), poly(behenylpolyethoxyethyl methacrylate), poly(ethylene adipate), poly (decamethylene adipate), poly(decamethylene azelaate), poly(hexamethylene oxalate), poly(decamethylene oxalate), poly(ethylene oxide), poly(propylene oxide), poly(butadiene oxide), poly(decamethylene oxide), poly(decamethylene sulfide), poly(decamethylene disulfide), poly(ethylene sebacate), poly(decamethylene sebacate), poly(ethylene suberate), poly(decamethylene succinate), poly(eicosamethylene malonate), poly(ethylene-p-carboxy phenoxy-undecanoate), poly(ethylene dithionesophthalate), poly(methyl ethylene terephthalate), poly(ethylene-p-carboxy phenoxy-valerate), poly(hexamethylene-4,4'-oxydibenzoate), poly(10-hydroxy capric acid), poly(isophthalaldehyde), poly(octamethylene dodecanedioate), poly(dimethyl siloxane), poly(dipropyl siloxane), poly(tetramethylene phenylene diacetate), poly (tetramethylene trithiodicarboxylate), poly(trimethylene dodecane dioate), poly(m-xylene), poly(p-xylylene pimelamide), and combinations thereof.

The amount of the crystalline polyester resin in a toner particle of the present disclosure, whether in core, shell or both, may be present in an amount of from 1 to about 15 percent by weight, in embodiments from about 5 to about 10 percent by weight, and in embodiments from about 6 to about 8 percent by weight, of the toner particles (that is, toner particles exclusive of external additives and water).

In embodiments, a toner of the present disclosure may also include at least one high molecular weight branched or cross-linked amorphous polyester resin. This high molecular weight resin may include, in embodiments, for example, a branched amorphous resin or amorphous polyester, a cross-linked amorphous resin or amorphous polyester, or mixtures thereof, or a non-cross-linked amorphous polyester resin that has been subjected to cross-linking. In accordance with the present disclosure, from about 1% by weight to about 100% by weight of the high molecular weight amorphous polyester resin may be branched or cross-linked, in embodiments from about 2% by weight to about 50% by weight of the higher molecular weight amorphous polyester resin may be branched or cross-linked.

As used herein, the high molecular weight amorphous polyester resin may have, for example, a number average molecular weight ($M_n$), as measured by gel permeation chromatography (GPC) of for example, from about 1,000 to about 10,000, in embodiments from about 2,000 to about 9,000, in embodiments from about 3,000 to about 8,000, and in embodiments from about 6,000 to about 7,000. The weight average molecular weight ($M_w$) of the resin is greater than 55,000, for example, from about 55,000 to about 150,000, in embodiments from about 60,000 to about 100,000, in embodiments from about 63,000 to about 94,000, and in embodiments from about 68,000 to about 85,000, as determined by GPC using polystyrene standard. The polydispersity index (PD) is above about 4, such as, for example, greater than about 4, in embodiments from about 4 to about 20, in embodiments from about 5 to about 10, and in embodiments from about 6 to about 8, as measured by GPC versus standard polystyrene reference resins. The PD index is the ratio of the weight-average molecular weight ($M_w$) and the number-average molecular weight ($M_n$). The high molecular weight amorphous polyester resins may have an acid value of from about 2 to about 30 mg KOH/g, in embodiments from about 9 to about 16 mg KOH/g, and in embodiments from about 11 to about 15 mg KOH/g. The high molecular weight amorphous polyester resins, which are available from a number of sources, can possess various melting points of, for example, from about 30° C. to about 140° C., in embodiments from about 75° C. to about 130° C., in embodiments from about 100° C. to about 125° C., and in embodiments from about 115° C. to about 121° C.

The high molecular weight amorphous resins, which are available from a number of sources, can possess various onset glass transition temperatures (Tg) of, for example, from about 40° C. to about 80° C., in embodiments from about 50° C. to about 70° C., and in embodiments from about 54° C. to about 68° C., as measured by differential scanning calorimetry (DSC). The linear and branched amorphous polyester resins, in embodiments, may be a saturated or unsaturated resin.

The high molecular weight amorphous polyester resins may prepared by branching or cross-linking linear polyester resins. Branching agents can be utilized, such as trifunctional or multifunctional monomers, which agents usually increase the molecular weight and polydispersity of the polyester. Suitable branching agents include glycerol, trimethylol ethane, trimethylol propane, pentaerythritol, sorbitol, diglycerol, trimellitic acid, trimellitic anhydride, pyromellitic acid, pyromellitic anhydride, 1,2,4-cyclohexanetricarboxylic acid, 2,5,7-naphthalenetricarboxylic acid, 1,2,4-butanetricarboxylic acid, combinations thereof, and the like. These branching agents can be utilized in effective amounts of from about 0.1 mole percent to about 20 mole percent based on the starting diacid or diester used to make the resin.

Compositions containing modified polyester resins with a polybasic carboxylic acid which may be utilized in forming high molecular weight polyester resins include those disclosed in U.S. Pat. No. 3,681,106, as well as branched or cross-linked polyesters derived from polyvalent acids or alcohols as illustrated in U.S. Pat. Nos. 4,863,825; 4,863,824; 4,845,006; 5,143,809; 5,057,596; 4,988,794; 4,981,939; 4,980,448; 4,933,252; 4,931,370; 4,917,983 and 4,973,539, the disclosures of each of which are incorporated by reference herein in their entirety.

In embodiments, cross-linked polyesters resins may be made from linear amorphous polyester resins that contain sites of unsaturation that can react under free-radical conditions. Examples of such resins include those disclosed in U.S. Pat. Nos. 5,227,460; 5,376,494; 5,480,756; 5,500,324; 5,601,960; 5,629,121; 5,650,484; 5,750,909; 6,326,119; 6,358,657; 6,359,105; and 6,593,053, the disclosures of each of which are incorporated by reference in their entirety. In embodiments, suitable unsaturated polyester base resins may be prepared from diacids and/or anhydrides such as, for example, maleic anhydride, terephthalic acid, trimellitic acid, fumaric acid, and the like, and combinations thereof, and diols such as, for example, bisphenol-A ethyleneoxide adducts, bisphenol A-propylene oxide adducts, and the like, and combinations thereof. In embodiments, a suitable polyester is poly (propoxylated bisphenol A co-fumaric acid).

In embodiments, a cross-linked branched polyester may be utilized as a high molecular weight amorphous polyester resin. Such polyester resins may be formed from at least two pre-gel compositions including at least one polyol having two or more hydroxyl groups or esters thereof, at least one aliphatic or aromatic polyfunctional acid or ester thereof, or a mixture thereof having at least three functional groups; and optionally at least one long chain aliphatic carboxylic acid or ester thereof, or aromatic monocarboxylic acid or ester thereof, or mixtures thereof. The two components may be reacted to substantial completion in separate reactors to produce, in a first reactor, a first composition including a pre-gel having carboxyl end groups, and in a second reactor, a second composition including a pre-gel having hydroxyl end groups. The two compositions may then be mixed to create a cross-linked branched polyester high molecular weight resin. Examples of such polyesters and methods for their synthesis include those disclosed in U.S. Pat. No. 6,592,913, the disclosure of which is hereby incorporated by reference in its entirety.

In embodiments, the cross-linked branched polyesters for the high molecular weight amorphous polyester resin may include those resulting from the reaction of dimethylterephthalate, 1,3-butanediol, 1,2-propanediol, and pentaerythritol.

Suitable polyols may contain from about 2 to about 100 carbon atoms and have at least two or more hydroxy groups, or esters thereof. Polyols may include glycerol, pentaerythritol, polyglycol, polyglycerol, and the like, or mixtures thereof. The polyol may include a glycerol. Suitable esters of glycerol include glycerol palmitate, glycerol sebacate, glycerol adipate, triacetin tripropionin, and the like. The polyol may be present in an amount of from about 20% to about 30% weight of the reaction mixture, in embodiments, from about 22% to about 26% weight of the reaction mixture.

Aliphatic polyfunctional acids having at least two functional groups may include saturated and unsaturated acids containing from about 2 to about 100 carbon atoms, or esters thereof, in some embodiments, from about 4 to about 20 carbon atoms. Other aliphatic polyfunctional acids include malonic, succinic, tartaric, malic, citric, fumaric, glutaric, adipic, pimelic, sebacic, suberic, azelaic, sebacic, and the like, or mixtures thereof. Other aliphatic polyfunctional acids which may be utilized include dicarboxylic acids containing a $C_3$ to $C_6$ cyclic structure and positional isomers thereof, and include cyclohexane dicarboxylic acid, cyclobutane dicarboxylic acid or cyclopropane dicarboxylic acid.

Aromatic polyfunctional acids having at least two functional groups which may be utilized include terephthalic, isophthalic, trimellitic, pyromellitic and naphthalene 1,4-, 2,3-, and 2,6-dicarboxylic acids.

The aliphatic polyfunctional acid or aromatic polyfunctional acid may be present in an amount of from about 40% to about 65% weight of the reaction mixture, in embodiments, from about 44% to about 60% weight of the reaction mixture.

Long chain aliphatic carboxylic acids or aromatic monocarboxylic acids may include those containing from about 12 to about 26 carbon atoms, or esters thereof, in embodiments, from about 14 to about 18 carbon atoms. Long chain aliphatic carboxylic acids may be saturated or unsaturated. Suitable saturated long chain aliphatic carboxylic acids may include lauric, myristic, palmitic, stearic, arachidic, cerotic, and the like, or combinations thereof. Suitable unsaturated long chain aliphatic carboxylic acids may include dodecylenic, palmitoleic, oleic, linoleic, linolenic, erucic, and the like, or combinations thereof. Aromatic monocarboxylic acids may include benzoic, naphthoic, and substituted naphthoic acids. Suitable substituted naphthoic acids may include naphthoic acids substituted with linear or branched alkyl groups containing from about 1 to about 6 carbon atoms such as 1-methyl-2 naphthoic acid and/or 2-isopropyl-1-naphthoic acid. The long chain aliphatic carboxylic acid or aromatic monocarboxylic acids may be present in an amount of from about 0% to about 70% weight of the reaction mixture, in embodiments, of from about 15% to about 30% weight of the reaction mixture.

Additional polyols, ionic species, oligomers, or derivatives thereof, may be used if desired. These additional glycols or polyols may be present in amounts of from about 0% to about 50% weight percent of the reaction mixture. Additional polyols or their derivatives thereof may include propylene glycol, 1,3-butanediol, 1,3-propanediol, 1,4-butanediol, 1,6-hexanediol diethylene glycol, 1,4-cyclohexanediol, 1,4-cyclohexanedimethanol, neopentyl glycol, triacetin, trimethylolpropane, pentaerythritol, cellulose ethers, cellulose esters, such as cellulose acetate, sucrose acetate iso-butyrate and the like.

In embodiments, the high molecular weight resin, for example a branched polyester, may be present on the surface of toner particles of the present disclosure. The high molecular weight resin on the surface of the toner particles ay also be particulate in nature, with high molecular weight resin particles having a diameter of from about 100 nanometers to about 300 nanometers, in embodiments from about 110 manometers to about 150 nanometers.

The amount of high molecular weight amorphous polyester resin in a toner particle of the present disclosure, whether in the core, the shell, or both, may be from about 25% to about 50% by weight of the toner, in embodiments from about 30% to about 45% by weight, in other embodiments or from about 40% to about 43% by weight of the toner (that is, toner particles exclusive of external additives and water).

The ratio of crystalline resin to the low molecular weight amorphous resin to high molecular weight amorphous polyester resin can be in the range from about 1:1:98 to about 98:1:1 to about 1:98:1, in embodiments from about 1:5:5 to about 1:9:9, in embodiments from about 1:6:6 to about 1:8:8.

Surfactants

In embodiments, resins, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, available from Rhone-Poulenc as IGEPAL CA-210™, IGEPAL CA-520™, IGEPAL CA-720™, IGEPAL CO-890™, IGEPAL CO-720™, IGEPAL CO290™, IGEPAL CA210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Toner

The resin of the resin emulsions described above, in embodiments a polyester resin, may be utilized to form toner compositions. Such toner compositions may include optional waxes, and other additives. Toners may be formed utilizing any method within the purview of those skilled in the art including, but not limited to, emulsion aggregation methods.

Wax

Optionally, a wax may also be combined with the resin in forming toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550P™, a low weight average molecular weight polypropylene available from Sanyo Kasei K. K.; plant based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner-particle shape and morphology.

In embodiments, toner compositions may be prepared by emulsion-aggregation processes, such as a process that includes aggregating a mixture of an optional wax and any other desired or required additives, and emulsions including the resins described above, optionally in surfactants as described above, and then coalescing the aggregate mixture. A mixture may be prepared by adding an optional wax or other materials, which may also be optionally in a dispersion(s) including a surfactant, to the emulsion, which may be a mixture of two or more emulsions containing the resin. The pH of the resulting mixture may be adjusted by an acid such as, for example, acetic acid, nitric acid or the like. In embodiments, the pH of the mixture may be adjusted to from about 2 to about 4.5. Additionally, in embodiments, the mixture may be homogenized. If the mixture is homogenized, homogenization ay be accomplished by mixing at about 600 to about 4,000 revolutions per minute. Homogenization may be accomplished by any suitable means, including, for example, an MA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1% to about 8% by weight, in embodiments from about 0.2% to about 5% by weight, in other embodiments from about 0.5% to about 5% by weight, of the resin in the mixture. This provides a sufficient amount of agent for aggregation.

In order to control aggregation and coalescence of the particles, in embodiments the aggregating agent may be metered into the mixture over time. For example, the agent may be metered into the mixture over a period of from about 5 to about 240 minutes, in embodiments from about 30 to about 200 minutes. The addition of the agent may also be done while the mixture is maintained under stirred conditions, in embodiments from about 50 rpm to about 1,000 rpm, in other embodiments from about 100 rpm to about 500 rpm, and at a temperature that is below the glass transition temperature of the resin as discussed above, in embodiments from about 30° C. to about 90° C., in embodiments from about 35° C. to about 70° C.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 40° C. to about 100° C., and holding the mixture at this temperature for a time from about 0.5 hours to about 6 hours, in embodiments from about hour 1 to about 5 hours, while maintaining stirring, to provide the aggregated particles.

Once the desired final size of the toner particles is achieved, the pH of the mixture may be adjusted by adding a base to a value of from about 6 to about 10, and in embodiments from about 6.2 to about 7. The adjustment of the pH may be utilized to stop toner growth. Examples of suitable bases include, but are not limited to, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above. The base may be added in amounts from about 2 to about 25 percent by weight of the mixture, in embodiments from about 4 to about 10 percent by weight of the mixture. In embodiments, the predetermined desired particle size is within the toner particle size ranges mentioned above.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

Shell Resin

In embodiments, after aggregation, but prior to coalescence, a shell may be applied to the aggregated particles.

Resins which may be utilized to form the shell include, but are not limited to, the amorphous resins described above for use in the core. Such an amorphous resin may be a low molecular weight resin, a high molecular weight resin, or combinations thereof. In embodiments, an amorphous resin which may be used to form a shell in accordance with the present disclosure may include an amorphous polyester of formula I above.

In some embodiments, the amorphous resin utilized to form the shell may be crosslinked. For example, crosslinking may be achieved by combining an amorphous resin with a crosslinker, sometimes referred to herein, in embodiments, as an initiator. Examples of suitable crosslinkers include, but are not limited to, for example free radical or thermal initiators such as organic peroxides and azo compounds described above as suitable for forming a gel in the core. Examples of suitable organic peroxides include diacyl peroxides such as, for example, decanoyl peroxide, lauroyl peroxide and benzoyl peroxide, ketone peroxides such as, for example, cyclohexanone peroxide and methyl ethyl ketone, alkyl peroxyesters such as, for example, t-butyl peroxy neodecanoate, 2,5-dimethyl 2,5-di(2-ethyl hexanoyl peroxy)hexane, t-amyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, oo-t-butyl o-isopropyl mono peroxy carbonate, 2,5-dimethyl 2,5-di(benzoyl peroxy)hexane, oo-t-butyl o-(2-ethyl hexyl)mono peroxy carbonate, and oo-t-amyl o-(2-ethyl hexyl)mono peroxy carbonate, alkyl peroxides such as, for example, dicumyl peroxide, 2,5-dimethyl 2,5-di(t-butyl peroxy)hexane, t-butyl cumyl peroxide, α-α-bis(t-butyl peroxy)diisopropyl benzene, di-t-butyl peroxide and 2,5-dimethyl 2,5di(t-butyl peroxy)hexyne-3, alkyl hydroperoxides such as, for example, 2,5-dihydro peroxy 2,5-dimethyl hexane, cumene hydroperoxide, t-butyl hydroperoxide and t-amyl hydroperoxide, and alkyl peroxyketals such as, for example, n-butyl 4,4-di(t-butyl peroxy)valerate, 1,1-di(t-butyl peroxy)3,3,5-trimethyl cyclohexane, 1,1-di(t-butyl peroxy)cyclohexane, 1,1-di(t-amyl peroxy)cyclohexane, (t-butyl peroxy)butane, ethyl 3,3-di(t-butyl peroxy)butyrate and ethyl 3,3-di(t-amyl peroxy)butyrate, and combinations thereof. Examples of suitable azo compounds include 2,2,'-azobis(2,4-dimethylpentane nitrile), azobis-isobutyronitrile, 2,2'-azobis(isobutyronitrile), 2,2'-azobis(2,4-dimethyl valeronitrile), 2,2'-azobis(methyl butyronitrile), 1,1'-azobis(cyano cyclohexane), other similar known compounds, and combinations thereof.

The crosslinker and amorphous resin may be combined for a sufficient time and at a sufficient temperature to form the crosslinked polyester gel. In embodiments, the crosslinker and amorphous resin may be heated to a temperature of from about 25° C. to about 99° C., in embodiments from about 30° C. to about 95° C., for a period of time of from about 1 minute to about 10 hours, in embodiments from about 5 minutes to about 5 hours, to form a crosslinked polyester resin or polyester gel suitable for use as a shell.

Where utilized, the crosslinker may be present in an amount of from about 0.001% by weight to about 5% by weight of the resin, in embodiments from about 0.01% by weight to about 1% by weight of the resin. The amount of CCA may be reduced in the presence of crosslinker or initiator.

A single polyester resin may be utilized as the shell or, as noted above, in embodiments a first polyester resin may be combined with other resins to form a shell. Multiple resins may be utilized in any suitable amounts. In embodiments, a first amorphous polyester resin, for example a low molecular weight amorphous resin of formula I above, may be present in an amount of from about 20 percent by weight to about 100 percent by weight of the total shell resin, in embodiments from about 30 percent by weight to about 90 percent by weight of the total shell resin. Thus, in embodiments a second resin, in embodiments a high molecular weight amorphous resin, may be present in the shell resin in an amount of from about 0 percent by weight to about 80 percent by weight of the total shell resin, in embodiments from about 10 percent by weight to about 70 percent by weight of the shell resin.

Coalescence

Following aggregation to the desired particle size, with the formation of an optional shell as described above, the particles may then be coalesced to the desired final shape, the coalescence being achieved by, for example, heating the mixture to a temperature of from about 55° C. to about 100° C., in embodiments from about 65° C. to about 75° C., in embodiments about 70° C., which may be below the melting point of the crystalline resin to prevent plasticization. Higher or lower temperatures may be used, it being understood that the temperature is a function of the resins used for the binder.

Coalescence may proceed and be accomplished over a period of from out 0.1 to about 9 hours, in embodiments from about 0.5 to about 4 hours.

After coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

Additives

In embodiments, the toner particles may also contain other optional additives, as desired or required. For example, the toner may include positive or negative charge control agents, for example in an amount of from about 0.1 to about 10 percent by weight of the toner, in embodiments from about 1 to about 3 percent by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Hodogaya Chemical); combinations thereof, and the like. Such charge control agents may be applied simultaneously with the shell resin described above or after application of the shell resin.

There can also be blended with the toner particles external additive particles including flow aid additives, which additives may be present on the surface of the toner particles. Examples of these additives include metal oxides such as titanium oxide, silicon oxide, tin oxide, mixtures thereof, and the like; colloidal and amorphous silicas, such as AEROSIL®, metal salts and metal salts of fatty acids inclusive of zinc stearate, aluminum oxides, cerium oxides, and mixtures thereof. Each of these external additives may be present in an amount of from about 0.1 percent by weight to about 5 percent by weight of the toner, in embodiments of from about 0.25 percent by weight to about 3 percent by weight of the toner. Suitable additives include those disclosed in U.S. Pat. Nos. 3,590,000, 3,800,588, and 6,214,507, the disclosures of each of which are hereby incorporated by reference in their entirety. Again, these additives may be applied simultaneously with a shell resin described above or after application of the shell resin.

In embodiments, toners of the present disclosure may be utilized as ultra low melt (ULM) toners. In embodiments, the dry toner particles, exclusive of external surface additives, may have the following characteristics:

(1) Volume average diameter (also referred to as "volume average particle diameter") of from about 3 to about 20 μm, in embodiments from about 4 to about 15 μm, in other embodiments from about 5 to about 9 μm.

(2) Number Average Geometric Standard Deviation (GSDn) and/or Volume Average Geometric Standard Deviation (GSDv) of from about 1.05 to about 1.55, in embodiments from about 1.1 to about 1.4.

(3) Circularity of from about 0.9 to about 1 (measured with, for example, a Sysmex FPIA 2100 analyzer), in embodiments form about 0.95 to about 0.985, in other embodiments from about 0.96 to about 0.98.

(4) Glass transition temperature of from about 40° C. to about 65° C., in embodiments from about 55° C. to about 62° C.

The characteristics of the toner particles may be determined by any suitable technique and apparatus. Volume average particle diameter $D_{50v}$, GSDv, and GSDn may be measured by means of a measuring instrument such as a Beckman Coulter Multisizer 3, operated in accordance with the manufacturer's instructions. Representative sampling may occur as follows; a small amount of toner sample, about 1 gram, may be obtained and filtered through a 25 micrometer screen, then put in isotonic solution to obtain a concentration of about 10%, with the sample then run in a Beckman Coulter Multisizer 3. Toners produced in accordance with the present disclosure may possess excellent charging characteristics when exposed to extreme relative humidity (RH) conditions. The low-humidity zone (C zone) may be about 10° C./15% RH, while the high humidity zone (A zone) may be about 28° C./85% RH. Toners of the present disclosure may also possess a parent toner charge per mass ratio (Q/m) of from about −3 μC/gram to about −90 μC/gram, in embodiments from about −10 μC/gram to about −80 μC/gram, and a final toner charging after surface additive blending of from −10 μC/gram to about −70 μC/gram, in embodiments from about −15 μC/gram to about −60 μC/gram.

In embodiments, an ionic crosslinker may be added to the toner compositions to further adjust the desired gloss of the toner compositions. Such ionic crosslinkers include, for example, $Al^{3+}$ crosslinkers, including aluminum sulfate ($Al(SO_4)_3$), polyaluminum chloride, polyaluminum sulfosilicate, and combinations thereof. The ionic crosslinkers are added to the toner formulation as flocculent agents. The degree of ionic crosslinking may be influenced by the amount of retained metal ion, such as $Al^+$, in the particle. The amount of retained metal ion may be further adjusted by the addition of EDTA in the formulation as described above. In embodiments, the amount of retained crosslinker, for example $Al^{3+}$, in toner particles of the present disclosure may be from about 20 parts per million (ppm) to about 1000 ppm, in other embodiments from about 500 ppm to about 800 ppm.

The resulting toners may be, in embodiments, a clear toner having a low and tunable gloss level. Utilizing the materials and methods of the present disclosure, one can thus produce invisible prints by matching the gloss level of the toner with the substrate to which the toner is to be applied. Thus, for example, the gloss level of a toner of the present disclosure may be adjusted from matte to gloss on paper, having a gloss as measured by Gardner Gloss Units (ggu) of from about 5 ggu to about 90 ggu, in embodiments from about 20 ggu to about 85 ggu.

In embodiments, the clear toner may be formed in two formulations, one glossy and one matte. The clear glossy toner is substantially devoid of metal ions and includes a limited amount of retained crosslinker, in embodiments $Al^{3+}$, from about 20 ppm to about 200 ppm and in embodiments from about 50 ppm to about 80 ppm. The clear matte toner retains the metal ions to produce a matte toner having a larger amount of retained crosslinker, from about 500 ppm to about 1000 ppm, in embodiments from about 600 ppm to about 800 ppm.

In embodiments a chelating agent may be added to the toner mixture during aggregation of the particles. Such chelating agents and their use in forming toners are described, for example, in U.S. Pat. No. 7,037,633, the disclosure of which is hereby incorporated by reference in its entirety. Examples of suitable chelating agents include, but are not limited to, chelates based on ammonia, diamine, triamine or tetramine, in embodiments, suitable chelating agents include, for example, organic acids such as ethylene diamine tetra acetic acid (EDTA), GLDA (commercially available L-glutamic acid N,N diacetic acid), humic and fulvic acids, peta-acetic and tetra-acetic acids; salts of organic acids including salts of methylglycine diacetic acid (MGDA), and salts of ethylenediamine disuccinic acid (EDDS); esters of organic acids including sodium gluconate, magnesium gluconate, potassium gluconate, potassium and sodium citrate, nitrotriacetate (NTA) salt; substituted pyranones including maltol and ethyl-maltol; water soluble polymers including polyelectrolytes that contain both carboxylic acid (COOH) and hydroxyl (OH) functionalities; and combinations thereof. Examples of specific chelating agents include

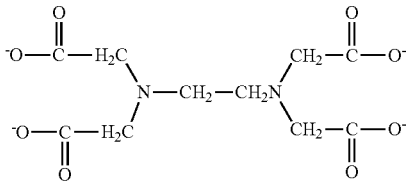

EDTA

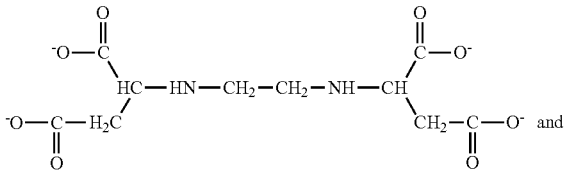

EDDS

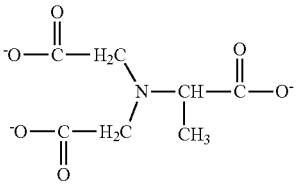

MGDA

In embodiments, EDTA, a salt of methylglycine diacetic acid (MGDA), or of salt of ethylenediamine disuccinic acid (EDDS), may be utilized as a chelating agent.

The amount of sequestering agent added may be from about 0.25 pph to about 4 pph, in embodiments from about 0.5 pph to about 2 pph. The chelating agent complexes or chelates with the coagulant metal ion, such as aluminum, thereby extracting the metal ion from the toner aggregate particles. The resulting complex is removed from the particle to lower the amount of retained aluminum in the toner. The amount of metal ion extracted may be varied with the amount of sequestering agent, thereby providing controlled crosslinking. For example, in embodiments, adding about 0.5 pph of the sequestering agent (such as EDTA) by weight of toner, may extract from about 40 to about 60 percent of the aluminum ions, while the use of about 1 pph of the sequestering agent (such as EDTA) may result in the extraction of from about 95 to about 100 percent of the aluminum.

The clear matte and glossy toners may then be blended to generate a blended toner having a suitable degree of gloss based on the ratio of the matte to gloss toners. In embodiments, the blended ratio of the clear glossy toner to the clear matte toner may be from about 5:95 to about 95:05, in embodiments from about 10:90 to about 90:10. The blending may be performed during production to obtain a clear toner of suitable gloss or during the printing process, by applying the matte and gloss toners in a suitable ratio to the print medium to generate a suitable degree of gloss concurrently with the printing process. Blending may accomplished using any suitable blending apparatus, such as a Henschel blender or any other type of suitable industrial high intensity blender/mixer, including those disclosed in a commonly-owned U.S. Pat. No. 6,805,481, the disclosure of which is hereby incorporated by reference in its entirety. In embodiments, the toners may be blended at speeds from about 1500 rpm to about 7000 rpm, in embodiments, from about 3000 revolutions per minute (rpm) to about 4500 rpm, for a period of time from about 2 minutes to about 30 minutes, in embodiments, from about 5 minutes to about 15 minutes, and at temperatures from about 20° C. to about 50° C., in embodiments, from about 22° C. to about 35° C. In other embodiments, the cross linker may be added to pigmented toners to provide for gloss effect without using additional developer housings.

One advantage of toners of the present disclosure, which may be used to prepare invisible watermarks, which differs from the use of inkjet printers, includes the simplified design of the electrophotographic machine and the ability to apply the toners of the present disclosure with such an electrophotographic machine.

Developers

The toner particles thus formed may be formulated into a developer composition. The toner particles may be mixed with carrier particles to achieve a two-component developer composition. The toner concentration in the developer may be from about 1% to about 25% by weight of the total weight of the developer, in embodiments from about 2% to about 15% by weight of the total weight of the developer.

Carriers

Examples of carrier particles that can be utilized for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 weight % to about 70 to about 30 weight %, in embodiments from about 40 to about 60 weight % to about 60 to about 40 weight %. The coating may have a coating weight of, for example, from about 0.1 to about 5% by weight of the carrier, in embodiments from about 0.5 to about 2% by weight of the carrier.

In embodiments, PMMA may optionally be copolymerized with any desired comonomer, so long as the resulting copolymer retains a suitable particle size. Suitable comonomers can include monoalkyl, or dialkyl amities, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size, coated with about 0.5% to about 10% by weight, in embodiments from about 0.7% to about 5% by weight of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition. However, different toner and carrier percentages may be used to achieve a developer composition with desired characteristics.

Imaging

The toners can be utilized for electrostatographic or electrophotographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with an electrophotographic device including a charging component, an imaging component, a photoconductive component, a developing component, a transfer component, and a fusing component. In embodiments, the development component may include a developer prepared by mixing a carrier with a toner composition described herein. The electrophotographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 210° C., in embodiments from about 100° C. to about 200° C., in other embodiments from about 120° C. to about 190° C., after or during, melting onto the image receiving substrate.

In embodiments where the toner resin is crosslinkable, such crosslinking may be accomplished in any suitable manner. For example, the toiler resin may be crosslinked during fusing of the toner to the substrate where the toner resin is crosslinkable at the fusing temperature. Crosslinking also may be effected by heating the fused image to a temperature at which the toner resin will be crosslinked, for example in a post-fusing operation. In embodiments, crosslinking may be effected at temperatures of from about 160° C. or less, in embodiments from about 70° C. to about 160° C., in other embodiments from about 80° C. to about 140° C.

FIG. 1 illustrates an exemplary electrophotographic apparatus (digital imaging system) which may be used with embodiments of the disclosed tunable gloss toners. Such digital imaging systems are disclosed in U.S. Patent Application Publication No. 200910257773 and U.S. Pat. No. 6,505,832, the disclosures of each of which are hereby incorporated by reference in their entirety.

The imaging system is used to produce an image, such as a color image output in a single pass of a photoreceptor belt. As shown in FIG. 1, an output management system 660 can supply printing jobs to a print controller 630. Printing jobs can be submitted from the output management system client 650 to the output management system 660. A pixel counter 670 is incorporated into the output management system 660 to count the number of pixels to be imaged with toner on each sheet or page of the job, for each color. The pixel count information is stored in the output management system 660 memory. The output management system 660 submits job control information, including the pixel count data, and the printing job to the print controller 630. Job control information, including the pixel count data and digital image data, are communicated from the print controller 630 to the controller 490.

The printing system can use a charge retentive surface in the form of an active matrix (AMAT) photoreceptor belt 410 supported for movement in the direction indicated by arrow 412, for advancing sequentially through the various electrophotographic process stations. In embodiments, the photoreceptor belt 410 is a continuous (endless) belt. The photoreceptor belt 410 is provided on a drive roll 414, tension roll 416 and fixed roll 418. The drive roll 414 is operatively connected to a drive motor 420 for moving the photoreceptor belt 410 sequentially through the electrophotographic stations.

During the printing process, a portion of the photoreceptor belt 410 passes through a charging station A including a corona generating device 422, which charges the photoconductive surface of photoreceptor belt 410 to a relatively high, substantially uniform potential. Next, the charged portion of the photoconductive surface of the photoreceptor belt 410 is advanced through an imaging/exposure station B. At the imaging/exposure station B, a controller 490 receives image signals from the print controller 630 representing the desired output image, and processes these signals to convert them to signals transmitted to a laser-based output scanning device, which causes the charged surface to be discharged in accordance with the output from the scanning device. In the exemplary system, the scanning device is a laser raster output scanner (ROS) 424. Alternatively, the scanning device can be a different electrophotographic exposure device, such as a light-emitting diode (LED) array. In embodiments, the desired output image may be a printer output or another image source.

The photoreceptor belt 410, which is initially charged to a voltage V0, undergoes dark decay to a level equal to about −500 volts. When exposed at the exposure station B, the photoreceptor belt 410 is discharged to a voltage level equal to about −50 volts. Thus, after exposure, the photoreceptor belt 410 contains a monopolar voltage profile of high and low voltages, with the high voltages corresponding to charged areas and the low voltages corresponding to discharged or developed areas.

At a first development station C, including a developer structure 432 utilizing a hybrid development system, a developer roll for "donor roll") is powered by two developer fields (potentials across an air gap) The first field is the AC field, which is used for toner cloud generation. The second field is the DC developer field, which is used to control the amount of developed toner mass on the photoreceptor belt 410. The toner cloud causes charged toner particles to be attracted to the electrostatic latent image. Appropriate developer biasing is accomplished via a power supply. This type of system is a non-contact type in which only toner particles (black, for example) are attracted to the latent image and there is no mechanical contact between the photoreceptor belt 410 and a toner delivery device to disturb a previously developed, but unfixed, image. A toner concentration sensor 200 senses the toner concentration in the developer structure 432.

The developed (unfixed) image is then transported past a second charging device 436 where the photoreceptor belt 410 and previously developed toner image areas are recharged to a predetermined level.

A second exposure/imaging may be performed by device 438 including a laser-based output structure, which selectively discharges the photoreceptor belt 410 on toned areas and/or bare areas, pursuant to the image to be developed with the second color toner. At this point of the process, the photoreceptor belt 410 contains toned and untoned areas at relatively high voltage levels, and toned and untoned areas at relatively low voltage levels. These low voltage areas represent image areas, which are developed using discharged area development (DAD). A negatively-charged, developer material 440 including color toner may be employed. The toner, e.g., yellow toner, is contained in a developer housing structure 442 disposed at a second developer station D and is transferred to the latent images on the photoreceptor belt 410 using a second developer system. A power supply (not shown) electrically biases the developer structure to a level effective to develop the discharged image areas with negatively charged yellow toner particles. Further, a toner concentration sensor can be used to sense the toner concentration in the developer housing structure 442.

The above procedure is repeated for a third image for a third suitable color toner, such as magenta (station E), and for a fourth image and suitable color toner, such as cyan (station F). The exposure control scheme described below may be utilized for these subsequent imaging steps. In this manner, a full-color composite toner image is developed on the photoreceptor belt 410. In addition, a one or more mass sensor 110 measures developed mass per unit area.

Stations G and H may include additional toners, such as different color toners (e.g., orange, green, violet) for extending the color gamut, or specialty toners such as security toners or clear toners for embossing effects, watermarks, and overprint "varnishes" to adjust gloss levels of the print. In embodiments, one of the stations G or H may be used to store a toner having a predetermined gloss level, in other embodiments, the toner stations G or H may include a matte toner of the present disclosure and a glossy toner of the present disclosure, or a blend of such matte and glossy toners as described above. The toner may be blended from a matte toner and a glossy toner to obtain a toner having a suitable level of gloss. The toner may be a clear toner having a desired level of gloss as measured by Gardner Gloss Units (ggu) of from about 5 ggu to about 90 ggu, in embodiments from about 20 ggu to about 85 ggu.

In embodiments, the station G may store a matte clear toner and the station H may store the gloss clear toner. The gloss level is adjusted by selecting a digital halftone blend of the two toners to achieve the desired gloss. Adjustments may be made via a user interface 492, which displays various options for blending the matte and gloss toners, such as halftone screens or line screens displaying types of halftone blends or other combinations of gloss to create a detailed transfer function from the user interface 492 to the printed product. Specialty effects such as placement of glossy and matte lines side by side may also be used to create security features. In embodiments, the user interface 492 may include a display and various other suitable input and output devices (e.g., keypads, touch-screen, etc.). The user interface 492 may display a selectable gloss level for each particular document and/or a specific portion thereof (e.g., individual pages).

Figure 6:
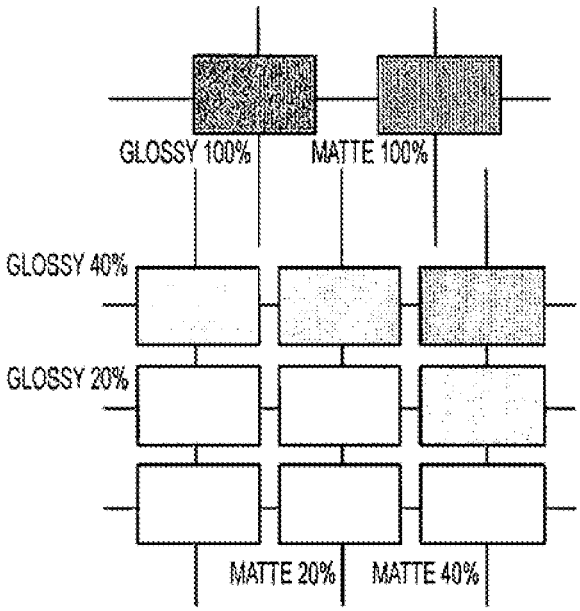
FIG. 6 is a selection matrix showing gloss levels with varying combinations of matte and gloss toners in forming a toner of the present disclosure.

In embodiments the user interface 492 may display a selection matrix (e.g., 3×3 matrix) as shown in FIG. 6, displaying the halftone density from 0% to 100% with one corner element of the matrix representing a pure matte selection and the opposite corner element representing a pure glossy selection, with the elements therebetween representing various degrees of blending. Line screens may also be used to represent a scale from 0% to 100% of a ratio of glossy to matte toner being used. The blend selections are then transmitted by the controller 490 to the stations G and H to apply a predetermined amount of clear glossy and matte toners, respectively, based on the selection entered into the user interface 492 to achieve a desired level of gloss on the print medium.

In ease some toner charge is totally neutralized, or the polarity reversed, thereby causing the composite image developed on the photoreceptor belt 410 to consist of both positive and negative toner, a negative pre-transfer dicorotron member 450 may be provided to condition the toner for effective transfer to a support sheet using positive corona discharge.

Subsequent to image development, a support sheet 452 (e.g., paper) is moved into contact with the toner images at transfer station I. The support sheet 452 is advanced to transfer station I by a sheet feeding apparatus 500. The support sheet 452 is then brought into contact with the photoconductive surface of photoreceptor belt 410 in a timed sequence so that the toner powder image developed on the photoreceptor belt 410 contacts the advancing support sheet 452 at the transfer station I.

The transfer station I includes a transfer dicorotron 454, which sprays positive ions onto the backside of the support sheet 452. The ions attract the negatively charged toner powder images from the photoreceptor belt 410 to the support sheet 452. A detack dicorotron 456 is provided for facilitating stripping of support sheets from the photoreceptor belt 410.

After transfer of the toner images, the support sheet continues to move, in the direction of arrow 458, onto a conveyor 600. The conveyor 600 advances the support sheet to a fusing station J. The fusing station J includes a fuser assembly 460, which is operable to permanently affix the transferred powder image to the support sheet 452. The fuser assembly 460 can include a heated fuser roll 462 and a pressure roll 464. The support sheet 452 passes between the fuser roll 462 and pressure roll 464 with the toner powder image contacting the fuser roll 462, causing the toner powder images to be permanently affixed to the support sheet 452. After fusing, a chute (not shown) guides the advancing support sheet 452 to a catch tray, stacker, finisher or other output device (not shown), for subsequent removal from the printing apparatus by the operator. The fuser assembly 460 can be contained within a cassette, and can include additional elements not shown in FIG. 1, such as a belt around the fuser roll 462.

After the support sheet 452 is separated from the photoconductive surface of the photoreceptor belt 410, residual toner particles carried by the non-image areas on the photoconductive surface are removed from the photoconductive surface. These toner particles are removed at cleaning station K using, e.g., a cleaning brush or plural brush structure contained in a housing 466. The cleaning brushes 468 are engaged after the composite toner image is transferred to a support sheet.

The controller 490 is operable to regulate the various printer functions. The controller 490 can be a programmable controller operable to control printer functions described above. For example, the controller 490 can be adapted to provide a comparison count of copy sheets, the number of documents being recirculated, the number of copy sheets selected by the operator, time delays, jam corrections, and/or other selected information. The control of all of the exemplary systems described above can be accomplished by conventional control switch inputs from the printing machine consoles selected by an operator. Conventional sheet path sensors or switches can be utilized to monitor the position of the document and copy sheets.

As noted above, one of the stations G or H may include a pre-blended toner of a matte toner and a glossy toner of the present disclosure with the other station G or H having a different color toners (e.g., orange, green, violet) for extending the color gamut, or specialty toners such as security toners or clear toners for embossing effects, watermarks, and overprint "varnishes" to adjust gloss levels of the print.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 30° C.

EXAMPLES

Example 1

Clear High Gloss Toner

About 258.01 grams (g) of an amorphous polyester resin having a glass transition temperature (Tg) of 56° C. in an emulsion about 35.2 by weight (wt %), about 254.77 g of 60.5° C. Tg amorphous polyester resin emulsion (about 36.0 wt %), about 71.34 g of crystalline polyester resin having a melting temperature (Tm) of 70° C. in an emulsion (about 30.5 wt %), about 2.85 g DOWFAX™ 2A1 (an alkyldiphenyloxide disulfonate from The Dow Chemical Company used as a dispersant), and about 94.31 g IGI wax emulsion (polyethylene wax) were added to about 1185 g of deionized water in a glass kettle and homogenized using IKA Ultra Turrax T50 homogenizer operating at approximately 4000 rpm. Thereafter, a flocculent made up of about 5.75 g of a 27.85% $Al_2(SO_4)$; solution mixed with about 153.84 g of deionized water was added drop-wise to the kettle while homogenizing the slurry for approximately 15 minutes.

The mixture was degassed for about 20 minutes at about 290 rpm and then heated at approximately 1° C. per minute to a temperature of about 38° C. at about 350 rpm for aggregation to take place. The particle size was monitored using a Coulter Counter until the particle size reached approximately 5.3 μm. A shell mixture, having about 128.55 g of 56° C. Tg amorphous polyester resin emulsion (35.2 wt %), about 126.93 g of 60.5° C. Tg amorphous polyester resin emulsion (36.0 wt %), about 0.96 g of DOWFAX™ 2A1 and approximately 102.92 g of deionized water, was immediately introduced into the reactor and allowed to aggregate for approximately 60 to about 70 minutes at about 38 to about 41° C. and about 340 rpm. After the volume average particle diameter was approximately above 5.7 μm, as measured by the Coulter Counter, the pH of the aggregated slurry was adjusted from approximately 3.0 to about 5.1 by the addition of 4 wt % of NaOH solution, followed by the addition of about 12.31 g ethylenediaminetetraacetic acid (EDTA) of 1.5 parts per hundred (pph), as to further increase the pH to approximately 7.8. The rpm was decreased to about 175 rpm and the pH was maintained at about 7.8 with 4 wt % NaOH to enable freezing of the toner aggregates.

After freezing, the toner slurry was heated to about 85° C. for approximately 45 minutes so that the particles could coalesce. The pH was slowly decreased from about 7.8 to about 6.2 with 0.3 Molar nitric acid to help spheroidize the toner particles. The toner particles had a final particle size (D50) of about 6.87 μm, geometric standard distribution (GSD) volume/number (v/n) 1.21/1.27, and circularity of about 0.978. The toner slurry was then quenched with ice to cool fairly quickly to room temperature. Finally, the toner was screened through a 25 μm sieve followed by three deionized water washes and freeze dried into a toner powder.

Example 2

Clear Matte Toner

About 258.01 g of 56° C. Tg amorphous polyester resin emulsion (about 35.2 wt %, about 254.77 g of 60.5° C. Tg amorphous polyester resin emulsion (about 36.0 wt %), about 71.34 of 70° C. Tm crystalline polyester resin emulsion (about 30.5 wt %), about 2.85 g DOWFAX™ 2A1, and about 94.31 g IGI wax emulsion (polyethylene wax) were added to approximately 1185 g of deionized water in a glass kettle and homogenized using IKA Ultra Turrax T50 homogenizer operating at approximately 4000 rpm. Thereafter, a flocculent made up of about 5.75 g of a 27.85% $Al_2(SO_4)_3$ solution mixed with about 153.84 g of deionized water was added drop-wise to the kettle while homogenizing the slurry for approximately 15 minutes.

The mixture was degassed for approximately 20 minutes at about 290 rpm and then heated at about 1° C. per minute to a temperature of approximately 38° C. at about 350 rpm for aggregation to take place. The particle size was monitored using a Coulter Counter until the particle size reached approximately 5.3 μm. A shell mixture of about 128.55 g of 56° C. Tg amorphous polyester resin emulsion (35.2 wt %), about 126.93 g of 60.5° C. Tg amorphous polyester resin emulsion (36.0 wt %), about 0.96 g of DOWFAX™ 2A1 and about 102.92 g of deionized water, was immediately introduced into the reactor and allowed to aggregate for about 60 to about 70 minutes at approximately 38 to about 41° C. and about 340 rpm. After the volume average particle diameter was about 5.7 μm or above, as measured by the Coulter Counter, the pH of the aggregated slurry was adjusted from about 3.0 to about 5.1 by the addition of 4 wt % of NaOH solution. The rpm was decreased to approximately 175 rpm and the pH was maintained at about 7.8 with 4 wt % NaOH to enable freezing of the toner aggregates.

After freezing, the toner slurry was heated to about 85° C. for approximately 45 minutes so that the particles could coalesce. The pH was slowly decreased from about 7.8 to about 6.2 with 0.3 Molar nitric acid to help spheroidize the toner particles. The toner particles had a final particle size ($D_{50}$) of about 7.10 μm. GSD v/n 1.37/1.34, and circularity of about 0.9448. The toner slurry was then quenched with ice to cool fairly quickly to approximately room temperature. Finally, the toner was screened through a 25 μm sieve followed by three deionized water washes and freeze dried into a toner powder.

Example 3

Toner Pre-Blending (Gloss:Matte)

An 80:20 blend of gloss:matte was created from about 40 grams of clear glossy toner of Example 1 being mixed with about 10 grams of clear matte toner of Example 2. A 50:50 blend was created from about 25 grams of clear glossy toner of Example 1 being mixed with about 25 grams of clear matte toner of Example 2. A 20:80 blend was created from about 10 grams of clear glossy toner of Example 1 being mixed with about 40 grams of clear matte toner of Example 2. A clear glossy toner of Example 1 and a clear matte toner of Example 2 were also used to prepare non-blended glossy and matte toners, respectively.

Five samples were prepared from non-blended and blended toners to test for the presence of $Al^{3+}$. Table 1 illustrates inductively coupled plasma spectrometry (ICP) measurements of the amount of $Al^{3+}$ present in the blends. The amount of residual Al correlated within experimental uncertainty with the blend ratio. For each sample, about 50 g of the toner were added to an SKM mill along with an additive package including silica, titania and zinc stearate and then blended for about 30 seconds at approximately 12500 rpm. The blended toner was then roll milled with about 365 grams of Xerox 994424 carrier to make a developer. The corresponding developer was then placed into a developer housing to produce unfused images on uncoated and coated paper before being fused.

TABLE 1

| ICP Measurement | |
|---|---|
| SAMPLE ID | Al(ppm) |
| Example 2 | 738 |
| Example 1:Example 2(20:80) | 558 |
| Example 1:Example 2(50:50) | 363 |
| Example 1:Example 2(80:20) | 169 |
| Example 1 | 53 |

Rheology Measurement

Figure 2:
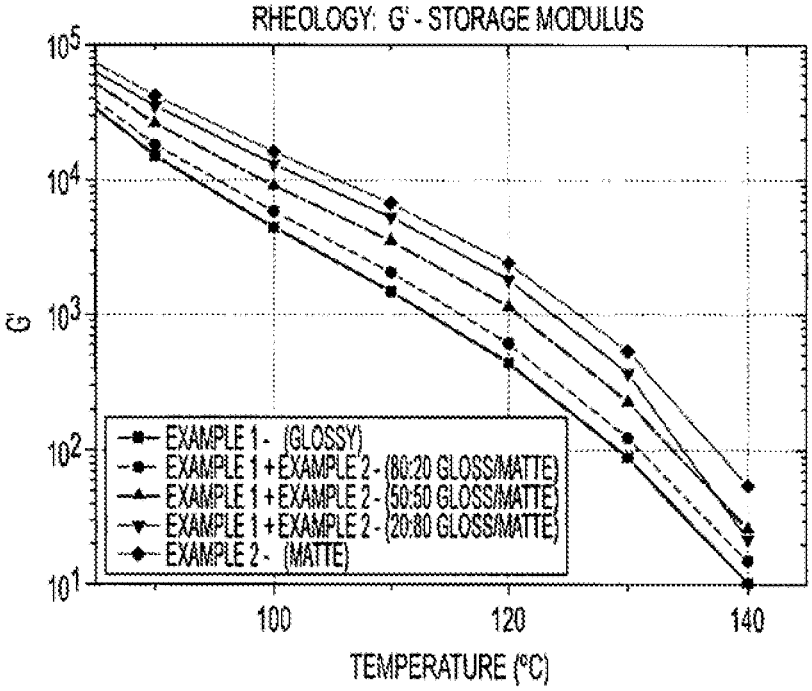
FIG. 2 is a graph comparing theological properties of blended toners of the present disclosure and non-blended toners.

FIG. 2 shows graphs illustrating the storage modulus of the toners at a range of temperatures. Storage modulus increased depending on the blend ratio of matte to gloss toners (or amount of residual $Al^{3+}$ left in the particles). The theological difference is correlated to the fused image gloss performance. Peak gloss moved down significantly as the as storage modulus increased.

Fusing Data

Unfused images were fused with a fusing fixture over a range of temperatures with the process speed being set to about 220 millimeter/second. The toners fused for the work did not contain pigment and crease fix was not measured for this set of samples since clear toner on white paper did not allow image analysis process of the creases. Visually, the samples had acceptable fix with the fuser set to 130° C.

Figure 3:
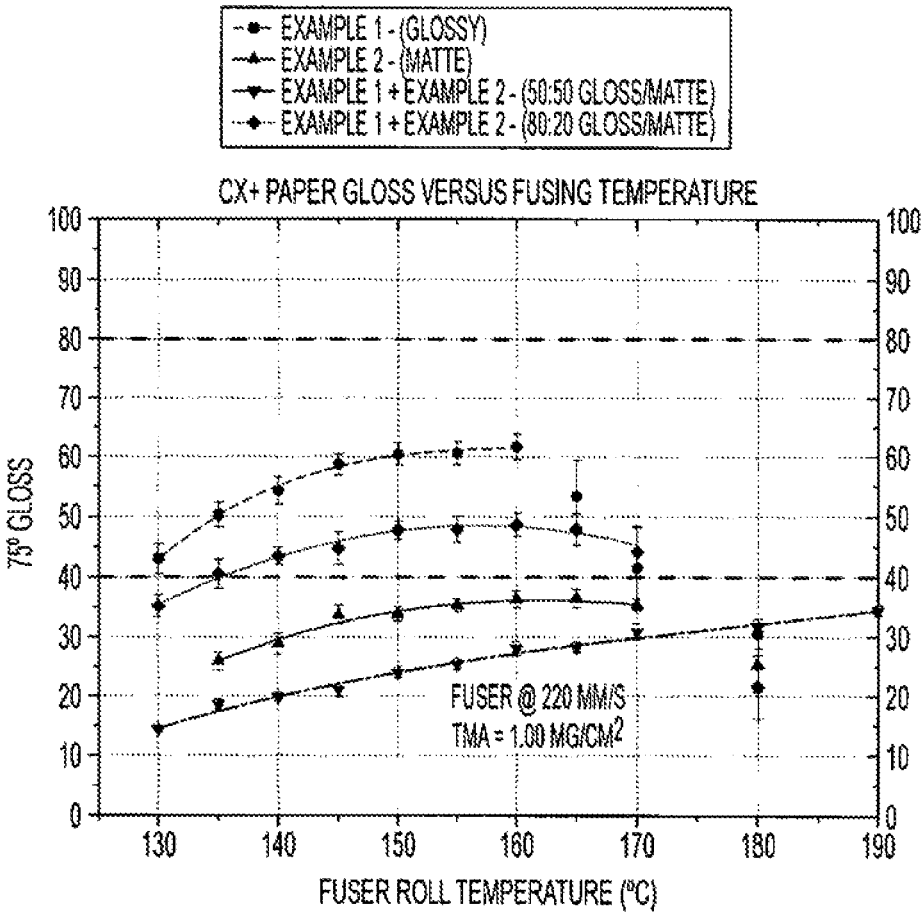
FIG. 3 is a graph showing gloss as a function of fuser roll temperature for a set of blended toners of the present disclosure on CX+ paper.
Figure 4:
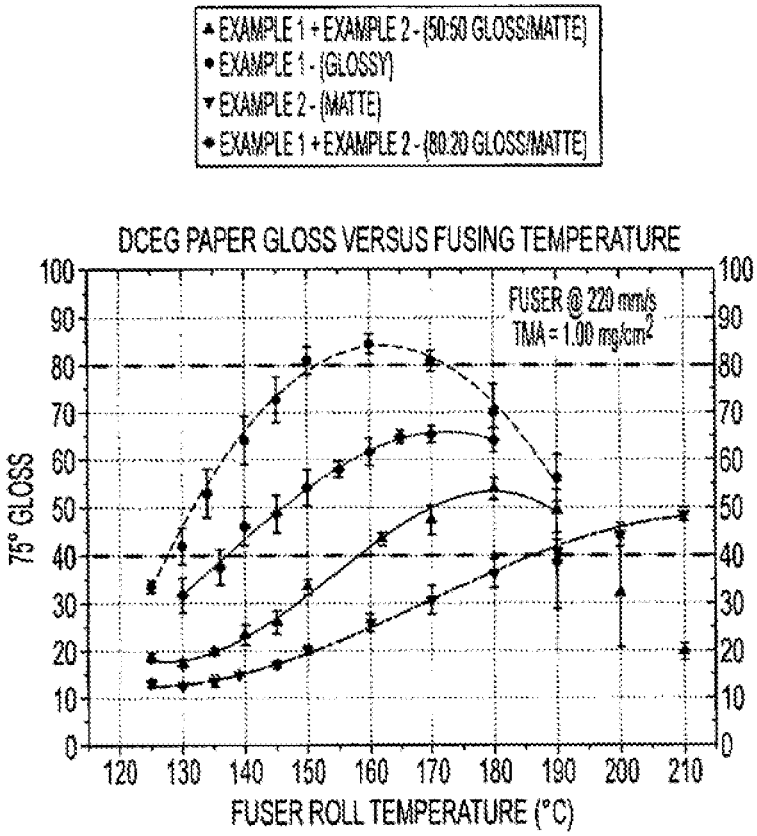
FIG. 4 is a graph showing gloss as a function of fuser roll temperature for a set of blended toners of the present disclosure on DCEG paper.
Figure 5:
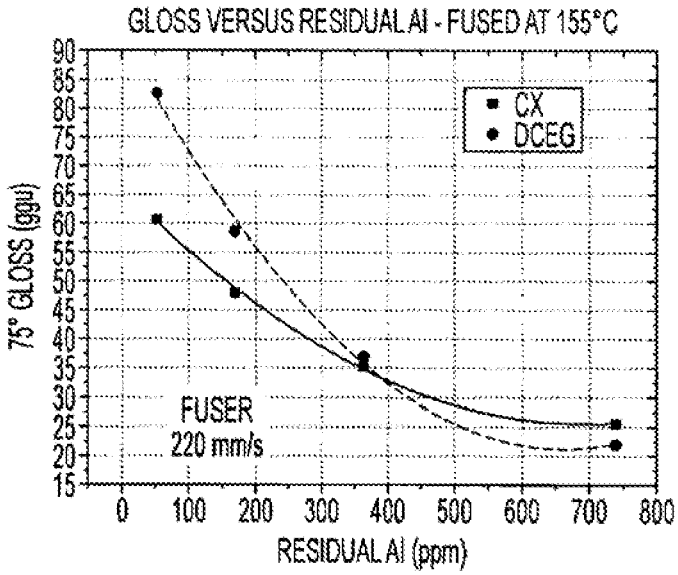
FIG. 5 is a graph showing metal ion content of toners of the present disclosure.

A plot of gloss as a function of fuser roll temperature for the set of blended toners on coated CX+ paper is shown in FIG. 3. The 20:80 blend data was not shown to minimize data overlap. Gloss values from about 60 ggu to about 20 ggu were possible depending on machine settings. Fusing results for the same set of samples fused onto coated DCEG paper are shown in FIG. 4. Print gloss form about 85 ggu to about 25 ggu are possible depending on the fuser roll temperature that was selected. Based on the fusing results for the blended samples a relationship between the blend ratio or the amount of residual $Al^{3+}$ was determined and is graphically illustrated in FIG. 5. The plot may be used to determine a suitable blend ratio of the clear matte and gloss toners to achieve a desired level of gloss (e.g., for 50 ggu on DCEG, the amount of residual $Al^{3+}$ in the blend should be about 250 ppm).

Example 4

Digital Toner Blending

A DocuColor™ 252 printer ("DC252") available from Xerox Corp. of Rochester, N.Y. was used to test-print clear tunable gloss toner. A glossy developer produced from a clear glossy toner of Example 1 was placed into a first developer housing at the Magenta position of the DC252. A matte developer produced from a clear matte toner of Example 2 was placed into a second developer housing at the Cyan position of the DC252. Standard developer housings and nominal machine settings were used. Unfused images on uncoated and coated paper with a toner mass per unit area (TMA) (corresponding to 100% patch) of about 032 mg/cm$^2$ for glossy developer and 0.45 mg/cm$^2$ for matte developer were generated. The amount of each toner printed was controlled by varying the halftone screen density on the user interface of the DC252 from 0% to 100% arranged in a matrix as shown in FIG. 6.

Fusing Data

Unfused images were fused with a fusing fixture over a range of temperatures with the process speed being set to about 220 mm/s. The toners fused for the work did not contain pigment and crease fix was not measured for this set of samples since clear toner on white paper did not allow image analysis process of the creases. Visually, the samples had acceptable fix with the fuser set to 130° C.

Figure 7:
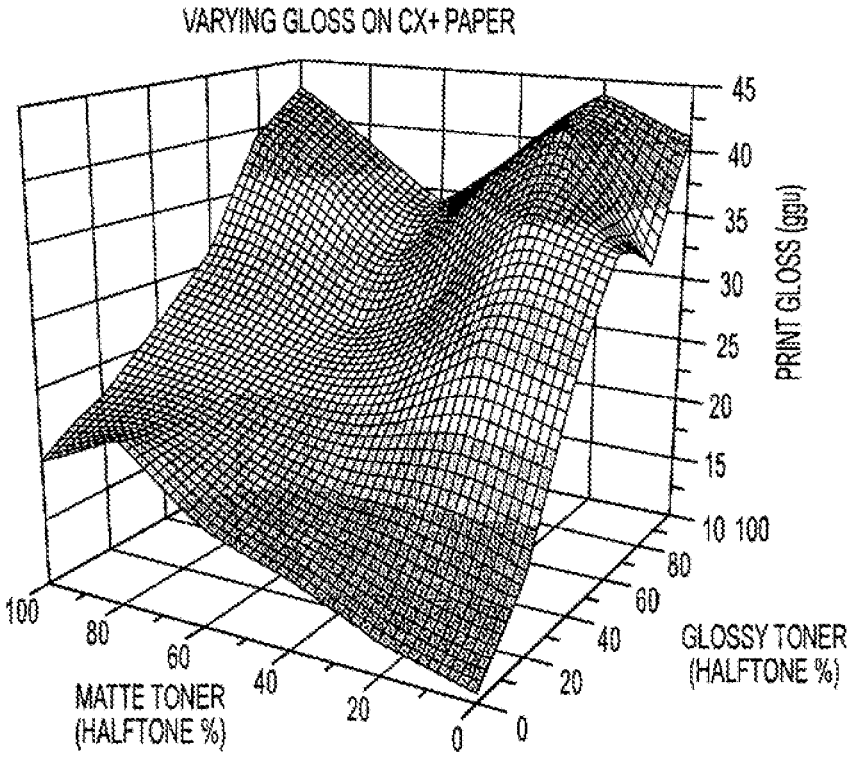
FIG. 7 is three-dimensional graph showing gloss as a function of blend ratio of ear matte and glossy toners of the present disclosure on CX+ paper.
Figure 8:
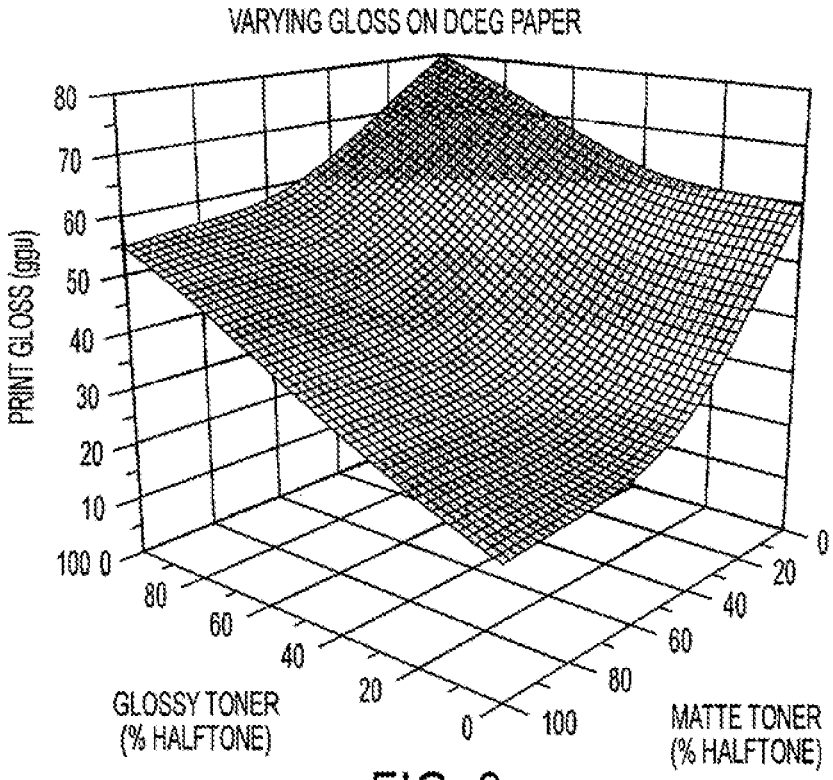
FIG. 8 are three-dimensional graphs showing gloss as a function of blend ratio of clear matte and glossy toners of the present disclosure on DCEG paper.

A plot of gloss with varying percentages of matte and gloss toner on uncoated paper is shown in FIG. 7. Gloss of the substrate was about 10 ggu, with levels of up to about 40 ggu being reachable with the TMA used for this experiment. (Higher gloss levels are possible with higher TMA's.) Fusing results for the same set of samples fused onto coated paper having a paper gloss of approximately 70 ggu are shown in FIG. 8. Print gloss from about 80 ggu to about 15 ggu were achieved depending on halftone/line screen used. The fusing results shown in FIGS. 7 and 8 for the digital blending of clear glossy and matte toner show that wide range of gloss is possible.

It will be appreciated that of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

We claim:

1. A process comprising: forming at least one glossy toner having an aluminum content from about 20 ppm to about 200 ppm; forming at least one matte toner having an aluminum content from about 500 ppm to about 1000 ppm; and contacting the at least one glossy toner and the at least one clear toner at a weight ratio from about 05:95 to about 95:05 to obtain a blended toner having a gloss level from about 5 ggu to about 90 ggu.

2. The process according to claim 1, wherein each of the at least one glossy toner and the at least one matte toner includes: at least one amorphous resin; at least one crystalline resin; at least one ionic crosslinker; optionally, at least one chelating agent; and optionally, one or more ingredients selected from the group consisting of waxes, coagulants, and combinations thereof.

3. The process according to claim 2 wherein the at least one ionic crosslinker is selected from the group consisting of aluminum sulfate, polyaluminum chloride, polyaluminum sulfosilicate, and combinations thereof and the at least one chelating agent selected from the group consisting of ethylene diamine tetra acetic acid (EDTA), L-glutamic acid N,N diacetic acid, humic acid, fulvic acid, pentaacetic acid, tetraacetic acid, methylglycine diacetic acid, ethylenediamine disuccinic acid and salts and combinations thereof.

4. The process according to claim 2, wherein the at least one amorphous resin is of the formula:

(I)

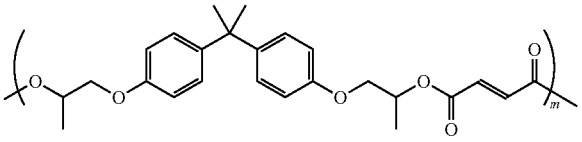

(II)

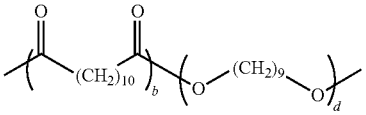

wherein m may be from about 5 to about 1000, and the crystalline resin is of the formula: wherein b is from about 5 to about 2000 and d is from about 5 to about 2000.

5. The process according to claim 2, wherein the at least one amorphous resin and the crystalline resin are present at a weight ratio of from about 99% to about 80% of the amorphous resin, to from about 1% to about 20% of the crystalline resin.

6. The process according to claim 1, wherein forming the at least one glossy toner further includes: contacting at least one amorphous resin and at least one crystalline resin in an emulsion; contacting the emulsion with at least one ionic crosslinker comprising aluminum; contacting the emulsion with at least one chelating agent; contacting the emulsion with an optional wax and an optional coagulant to form a mixture; aggregating small particles in the mixture to form a plurality of larger aggregates; coalescing the larger aggregates to form glossy toner particles; and recovering the particles.

7. The process according to claim 1, wherein forming the at least one clear matte toner further includes: contacting at least one amorphous resin and at least one crystalline resin in an emulsion; contacting the emulsion with at least one ionic crosslinker comprising aluminum; contacting the emulsion with an optional wax and an optional coagulant to form a mixture; aggregating small particles in the mixture to form a plurality of larger aggregates; coalescing the larger aggregates to form clear matte toner particles; and recovering the particles.

8. A toner comprising: at least one glossy toner having an aluminum content from about 20 ppm to about 200 ppm; and at least one matte toner having an aluminum content from about 500 ppm to about 1000 ppm; wherein the at least one glossy toner and the at least one matte toner are present at a weight ratio from about 05:95 to about 95:05 and the toner has a gloss level from about 5 ggu to about 90 ggu.

9. The toner according to claim 8, wherein each of the at least one glossy toner and the at least one matte toner comprises: at least one amorphous resin; optionally at least one crystalline resin; at least one ionic crosslinker; optionally at least one chelating agent; and optionally, one or more ingredients selected from the group consisting of waxes, coagulants, and combinations thereof.

10. The toner according to claim 9, wherein the at least one ionic crosslinker is selected from the group consisting of aluminum sulfate, polyaluminum chloride, polyaluminum sulfosilicate, and combinations thereof.

11. The toner according to claim 9, wherein the at least one chelating agent selected from the group consisting of ethylene diamine tetra acetic acid (EDTA), L-glutamic acid N,N diacetic acid, humic acid, fulvic acid, pentaacetic acid, tetraacetic acid, methylglycine diacetic acid, ethylenediamine disuccinic acid and salts and combinations thereof.

12. The toner according to claim 9, wherein the at least one amorphous resin and the crystalline resin are present at a weight ratio of from about 99% to about 80% of the amorphous resin, to from about 1% to about 20% of the crystalline resin.

13. The toner according to claim 8, comprising an emulsion aggregation toner.

14. The toner according to claim 8, further comprising a shell.

15. The toner according to claim 14, wherein said shell comprises a crosslinked resin.

16. The toner according to claim 9, wherein said at least one amorphous resin comprises a high molecular weight resin and a low molecular weight resin.

17. The toner according to claim 8, comprising a low melt toner.

18. The toner of claim 8, wherein said glossy toner comprises an aluminum content of from about 50 ppm to about 80 ppm.

19. The toner of claim 9, further comprising a colorant.

20. The toner of claim 8, wherein the at least one glossy toner and the at least one matte toner are present at a weight ratio from about 10:90 to about 90:10.

* * * * *